US005911493A

United States Patent [19]

Walker et al.

[11] Patent Number: 5,911,493

[45] Date of Patent: Jun. 15, 1999

[54] ILLUMINATED UMBRELLA

[76] Inventors: Robert Lawrence Walker, 106 San Michael, Victoria Road, Clifton 8001, South Africa; Leslie Ronald Wittenberg, 20A Herschel Walk, Wynberg 7700, South Africa

[21] Appl. No.: 08/997,425

[22] Filed: Dec. 23, 1997

[30] Foreign Application Priority Data

Jan. 9, 1997 [ZA] South Africa ..... 97/0186

[51] Int. Cl.[6] ..... A45B 3/02

[52] U.S. Cl. ..... 362/102; 135/16; 135/910

[58] Field of Search ..... 362/32, 102, 192, 362/234, 431, 249; 135/16, 910

[56] References Cited

U.S. PATENT DOCUMENTS 4,848,385 7/1989 Pennella ..... 135/16

5,053,931 10/1991 Rushing ..... 362/102

5,323,798 6/1994 Yang ..... 135/16

5,502,624 3/1996 Tu ..... 362/102

5,584,564 12/1996 Phyle ..... 362/102

5,611,614 3/1997 Morgan ..... 362/102

*Primary Examiner*—Thomas M. Sember

*Attorney, Agent, or Firm*—Ladas & Parry

[57] ABSTRACT

The invention provides for an umbrella, part of which is indicated by reference numeral 10. The umbrella 10 includes a post 12, a plurality of ribs 16 and a canopy, not shown, supported on the ribs 16. The umbrella 10 further includes a light source in the form of a length of rope lighting 32 carried by and extending along each of the ribs 16.

11 Claims, 1 Drawing Sheet

ILLUMINATED UMBRELLA

This invention relates to umbrellas.

According to the present invention, there is provided an umbrella including a post;

a plurality of ribs, ends of which are mounted on the post;

a canopy supported on the ribs; and a light source carried by and extending along at least one of the ribs.

The umbrella may include pivotal connections at an upper end of the post whereby the ends of the ribs are pivotally mounted on the post to enable the ribs to be swung between an operative position in which they extend radially outwardly from the post and an inoperative position in which they hang adjacent the post.

The umbrella may include a hub carrying the pivotal connections, the hub being mounted on the upper end of the post.

At least one electrical socket may be provided on the hub, the light source including a complementary plug releasably connectable to the socket.

The umbrella may include an electrical cable connected to the electrical socket and whereby the socket is connectable to an electrical power source remote therefrom.

The post may be hollow, at least a portion of the cable extending from the hub to a lower end portion of the post.

The umbrella may include a light source carried by and extending along each of at least some of the ribs.

Preferably, the umbrella includes a light source carried by and extending along each of the ribs.

A plurality of electrical sockets mounted on the hub may be provided, each light source having a complementary plug which is releasably connectable to one of the sockets.

The hub may define an internal cavity and circumferentially spaced holes extending from the cavity to positions outside the hub, the electrical sockets being located in the holes.

The hub may have an access opening leading into the cavity and a cover for releasably closing the access opening.

The, or each, light source may be defined by a length of rope lighting.

The, or each, rib may include a downwardly open channel formation extending along its length, the length of rope lighting being held between opposed walls of the channel formation.

Accordingly, in a preferred form, each rib is pivotally mounted on a hub which is itself carried by the pole so that each rib can be swung between an operative position in which it extends radially outwardly from the pole and an inoperative position in which it hangs down adjacent the pole, electrical sockets carried by the hub, and means for securing said lengths of rope lighting along the undersides of the ribs, each length of rope lighting including a loop which extends between the means which mounts that length of rope lighting and said socket.

Figure 1:
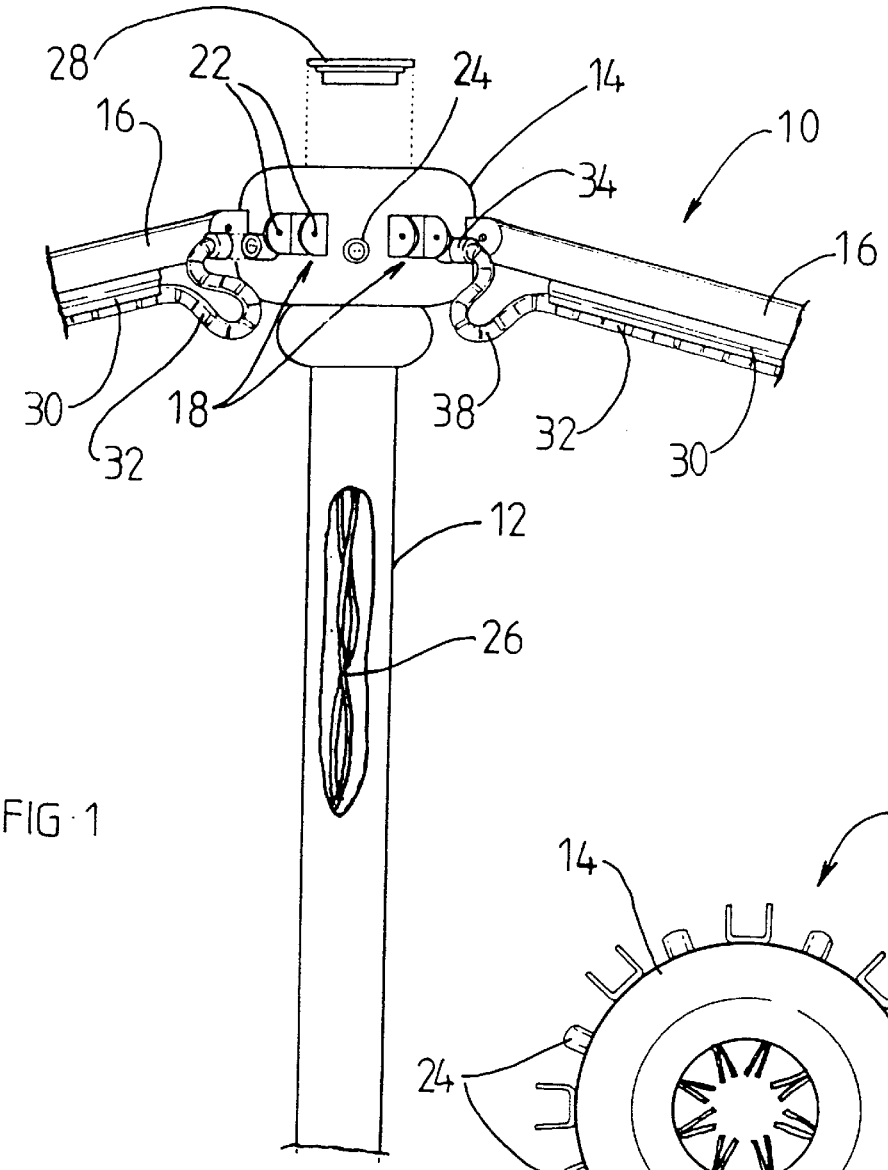
Figure 2:
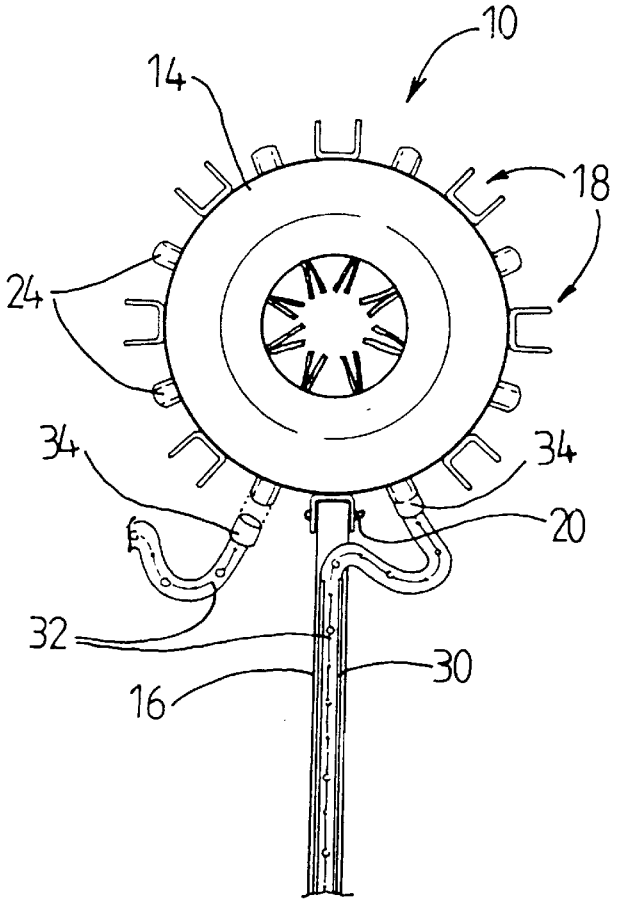

For a better understanding of the present invention, and to show how the same may be carried into effect, reference will now be made, by way of example, to the accompanying drawings in which:

FIG. 1 is a diagrammatic side elevation of part of an umbrella in accordance with the present invention; and FIG. 2 is a diagrammatic bottom plan view of the umbrella of FIG. 1.

The umbrella illustrated is generally designated 10 and comprises a hollow post or pole 12, a hollow hub 14 which is fixed to the upper end of the pole 12 and a plurality of ribs 16 which radiate from the hub 14. Two ribs are shown in FIG. 1 but only one in FIG. 2.

The hub 14 carries a plurality of brackets 18. A web of each bracket 18 is secured to the hub 14 and pins 20 passed through holes 22 in opposed flanges of the brackets 18 form pivotal connections whereby radially inner ends of the ribs 16 are pivotally mounted to the upper end of the pole 12.

A plurality of electrical sockets 24 are also mounted on the hub 14, the sockets 24 alternating with the brackets 18. The sockets 24 are mounted in holes in the hub 14 so that the inner end of each socket 24 is within the cavity which the hollow hub 14 provides.

Power is supplied to the sockets 24 by cabling 26 which extends upwardly through the hollow pole 12, enters the cavity within the hollow hub 14 and is connected to the inner ends of the sockets 24.

After the connections have been made between the cabling 26 and the inner ends of the sockets 24, a cap 28 is pressed into an open upper end of the cavity within the hub 14 to close it off.

Downwardly open elongate channels 30 are secured to the undersides of the ribs 16. Each channel 30 has pressed into it a light source in the form of a length of rope lighting 32 so that each length of rope lighting 32 is carried by and extends along an associated rib 16. At its radially outer end each length of rope lighting 32 is closed-off by an end cap (not shown) and at the radially inner end each length of rope lighting 32 includes a plug 34 which is pushed into the adjacent socket 24 to be electrically connected thereto.

Rope lighting consists of an extruded length of synthetic plastics material. The synthetic plastics material is flexible and has at intervals therealong sources of light. These sources are connected together by wires which run through the extrusion. When connected to a source of electricity, rope lighting is illuminated throughout its length.

Because the rope lighting is flexible, a loop 38 can be provided in each length between the radially inner end of the channel 30 and the plug 34. The loops 38 accommodate pivoting movement of the ribs 16 about the axes of the pins 20 between the extended, operative positions as shown in the drawings and inoperative positions in which the ribs hang down adjacent the pole 12.

On the pole 12 below the hub 14 there is a sleeve 40. Struts 42 are pivotally mounted at their inner ends on the sleeve and at their outer ends on the ribs 16 at points intermediate the ends of the ribs. There are means 44 for releasably securing the sleeve to the pole. The umbrella is opened by sliding the sleeve up the pole so that the struts push the ribs outwardly. The sleeve is releasably attached to the pole in its upper position. When the releasable attaching means is freed, the sleeve can slide down the pole. The inner ends of the struts move down with the sleeve thereby permitting the ribs to swing down to their inoperative positions.

We claim:

1. An umbrella including;

a post;

a plurality of ribs, ends of which are mounted on the post;

a canopy supported on the ribs;

a light source carried by and extending along at least one of the ribs;

pivotal connections at an upper end of the post whereby the ends of the ribs are pivotally mounted on the post to enable the ribs to be swung between an operative position in which they extend radially outwardly from the post and an inoperative position in which they hang adjacent to the post, the post having a hub at the upper end thereof and the hub carrying said pivotal connections; and at least one electrical socket on the hub, the light source including a complementary plug releasably connectable to the socket.

2. An umbrella as claimed in claim 1, which includes an electrical cable connected to the electrical socket and whereby the socket is connectable to an electrical power source remote therefrom.

3. An umbrella as claimed in claim 2, in which the post is hollow, at least a portion of the cable extending from the hub to a lower end portion of the post.

4. An umbrella as claimed in claim 1, which includes a light source carried by and extending along each of at least some of the ribs.

5. An umbrella as claimed in claim 4, which includes a light source carried by and extending along each of the ribs.

6. An umbrella as claimed in claim 1, which includes a plurality of electrical sockets mounted on the hub, each light source having a complementary plug which is releasably connectable to one of the sockets.

7. An umbrella as claimed in claim 6, in which the hub defines an internal cavity and circumferentially spaced holes extending from the cavity to positions outside the hub, the electrical sockets being located in the holes.

8. An umbrella as claimed in claim 7, in which the hub has an access opening leading into the cavity and a cover for releasably closing the access opening.

9. An umbrella as claimed in claim 1, in which the or each light source is defined by a length of rope lighting.

10. An umbrella as claimed in claim 9, in which the or each rib includes a downwardly open channel formation extending along its length, the length of rope lighting being held between opposed walls of the channel formation.

11. An umbrella including:

a hollow post;

a plurality of ribs, ends of which are mounted on the post;

a canopy supported on the ribs;

a light source carried by and extending along at lest one of the ribs;

pivotal connections at an upper end of the post whereby the ends of the ribs are pivotally mounted on the post to enable the ribs to be swung between an operative position in which they extend radially outwardly from the post and an inoperative position in which they hang adjacent the post, the post having a hub at the upper end thereof and the hub carrying said pivotal connections; and an electrical cable whereby the light source is connectable to an electrical power source, the cable extending along the hollow interior of the post to the hub, and there being a disconnectable electrical plug and socket connection between the light source and said cable.

* * * * *